US007349653B2

(12) United States Patent
Nishihama et al.

(10) Patent No.: US 7,349,653 B2
(45) Date of Patent: Mar. 25, 2008

(54) DEVELOPING APPARATUS AND IMAGE FORMING METHOD FEATURING COLORED AND TRANSPARENT TONERS

(75) Inventors: Tadayoshi Nishihama, Abiko (JP); Tadashi Fukuda, Toride (JP); Kota Arimoto, Abiko (JP); Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 149 days.

(21) Appl. No.: 11/349,903

(22) Filed: Feb. 9, 2006

(65) Prior Publication Data

US 2006/0198661 A1 Sep. 7, 2006

(30) Foreign Application Priority Data

Mar. 7, 2005 (JP) ..... 2005-063180

(51) Int. Cl.
*G03G 15/01* (2006.01)
*G03G 15/08* (2006.01)

(52) U.S. Cl. ..... 399/223; 399/257; 399/258

(58) Field of Classification Search ..... 399/223, 399/226, 227, 258, 257, 27, 28, 53, 58; 430/120.1
See application file for complete search history.

(56) References Cited

U.S. PATENT DOCUMENTS

| | | | | |
|---|---|---|---|---|
| 5,260,753 | A | 11/1993 | Haneda et al. | 399/54 |
| 5,780,191 | A * | 7/1998 | Ide | 430/45.1 |
| 2005/0214006 | A1* | 9/2005 | Bessho | 399/49 |
| 2005/0214669 | A1* | 9/2005 | Hayashi et al. | 430/109.4 |
| 2006/0051114 | A1* | 3/2006 | Ng | 399/53 |

FOREIGN PATENT DOCUMENTS

| | | | |
|---|---|---|---|
| JP | 59-100471 | | 6/1984 |
| JP | 2-21591 | | 5/1990 |
| JP | 4-278967 | | 10/1992 |
| JP | 5-6033 | | 1/1993 |
| JP | 5-127437 | | 5/1993 |
| JP | 06-004007 | A * | 1/1994 |
| JP | 10-319663 | A * | 12/1998 |
| JP | 2000-147863 | | 5/2000 |
| JP | 2002-202645 | A * | 7/2002 |
| JP | 2003-173060 | A * | 6/2003 |
| JP | 2004-309721 | A * | 11/2004 |

* cited by examiner

*Primary Examiner*—Sophia S. Chen
(74) *Attorney, Agent, or Firm*—Fitzpatrick, Cella, Harper & Scinto

(57) ABSTRACT

A developing apparatus includes a developing device for color receiving colored toner and a carrier and developing an electrostatic image; a developing device for transparence receiving transparent toner and a carrier and developing the electrostatic image; a developer replenishment container for color receiving a replenishment developer for color; a developer replenishment container for transparence receiving a replenishment developer for transparence; a developer discharge aperture for color; and a developer discharge aperture for transparence, respectively, discharging developers in the developing devices to the outside of the developing devices in association with replenishment with the replenishment developers and a related image forming method. The replenishment developer for transparence has a carrier weight ratio lower than a carrier weight ratio in the replenishment developer for color.

6 Claims, 6 Drawing Sheets

DEVELOPING APPARATUS AND IMAGE FORMING METHOD FEATURING COLORED AND TRANSPARENT TONERS

BACKGROUND OF THE INVENTION

1. Field of the Invention

The present invention generally relates to a developing apparatus and an image forming method each used for an image forming apparatus such as a copying machine or a printer. In particular, the present invention relates to a developing apparatus and an image forming method in which colored toner and transparent toner are used by a two-component development mode.

2. Related Background Art

Conventionally, a two-component development mode in which non-magnetic toner and magnetic carrier are mixed and used as a developer has been widely used in an image forming apparatus employing an electrophotographic mode, in particular, an image forming apparatus performing the formation of a chromatic color image.

The two-component development mode has merits over any other development mode currently adopted such as the stability of image quality and the durability of an apparatus against long-term use. However, the deterioration of the developer due to the long-term use, in particular, a reduction in charge amount (hereinafter referred to as "triboelectricity") of toner due to the deterioration of the carrier causes a change in developability. As a result, for example, an image failure such as a fluctuation in tint or toner scattering occurs with increasing number of sheets on which images are outputted. Therefore, the long-term use of the image forming apparatus requires a downtime (a time period for which the image output cannot be performed owing to, for example, the adjustment of the apparatus) and labor for replacing a developer.

In view of the foregoing, Japanese Patent Examined Publication No. H02-021591 has proposed a method of saving labor for replacing the developer while maintaining the performance of the developer to some extent involving: gradually collecting the deteriorated developer; and newly replenishing the developer in an amount corresponding to the amount of the collected developer. In other words, the deteriorated developer (carrier) is gradually replaced with a new one, with the result that the following advantage can be obtained. That is, the apparent progress of the deterioration of the carrier stops, the properties of the entire developer can be stabilized, and the automatic replacement of the developer can eliminate an operation of replacing the developer.

In particular, in recent years, in electrophotography using the two-component development mode, there has been a growing demand on the output of a stable image with a downtime reduced as much as possible in, for example, a POD market. A technique for reducing the downtime as proposed in Japanese Patent Examined Publication No. H02-021591 is useful in meeting the demand. Furthermore, the deterioration of the developer can be stabilized at a certain level, so the fluctuation in image quality due to the deterioration of the developer can be prevented.

The deterioration of the carrier can be represented as the reduction in ability of the carrier to provide toner with triboelectricity. To be specific, an ability to provide triboelectricity gradually reduces owing to the shaving of a coating agent with which the carrier is coated and the adhesion of toner/an external additive to the surface of the carrier, so the carrier deteriorates.

The technique proposed in Japanese Patent Examined Publication No. H02-021591 enables the deterioration of the carrier in the developer container to be prevented. This is because the level at which the carrier deteriorates can be changed depending on the frequency of the replenishment/discharge of the carrier per number of outputted sheets.

Simply speaking, the increase in frequency of the replacement of the carrier causes the developer to be stably present in a state with improved freshness. Here, the variation in level at which the carrier deteriorates with the image ratio will be further described.

A time period for which each carrier is used in the developer container is represented as an "age" in a unit of number of A4-size recording materials on each of which the image is outputted. Here, let P(x) and W(g) be the average age of carriers in the developer container at a certain number x of sheets on which images are outputted in a durability test and the total amount of the carriers in the developer container, respectively. In addition, when one image is additionally formed, d(g) of a new carrier is replenished in accordance with the consumption of toner, while d(g) of the developer present in the developer container is similarly discharged.

For convenience of calculation, suppose that image formation and the replacement of the carrier are performed serially in a time series. Let P(x) and Q(x) be the average age of carriers immediately after the formation of x images and immediately before the replacement of the carrier and the average age of the carriers immediately after the replacement of the carrier, respectively. Therefore, the following expression can be obtained.

$$Q(x)=P(x)\times[(W-d)/W]+P(0)\times[d/W] \quad (1)$$

Here, P(0)=0 because P(0) is an initial average age. Therefore, the following expression can be obtained.

$$Q(x)=P(x)\times[(W-d)/W] \quad (2)$$

P(x+1) corresponds to a state where one image is additionally formed in a state where the average age is Q(x). Since carriers are supposed to be equally used for image formation during a period commencing on the state where the average age is Q(x) and ending on the state represented by P(x+1), the following expression can be obtained.

$$P(x+1)=Q(x)+1 \quad (3)$$

Combining the expressions (2) and (3) yields the following expression.

$$P(x+1)=P(x)\times[(W-d)/W]+1 \quad (4)$$

That is, the following expression can be obtained.

$$P(x)=[1-(1-d/W)^x]\times W/d \quad (5)$$

In other words, the average age of the carriers after the automatic replacement of the developer converges on W/d (=the total amount of the carriers in the developer container/the amount of the replaced carrier per sheet).

To be specific, when the amount of the developer in a developer container is 375 g and the toner concentration of the developer in the developer container (a ratio of the weight of toner to the total weight of the developer: hereinafter referred to as the "TD ratio") is 8%, the amount of the carrier is about 345 g. Then, the weight ratio of the carrier of the developer for replenishment (hereinafter referred to as the "replenishment developer") (the ratio of the carrier weight to the total weight of the developer: hereinafter referred to as the "CD ratio") is 15%. When the bearing amount of toner for outputting a maximum concentration is 0.7 mg/cm$^2$, 21.3 mg of toner per A4-size recording material is used in the case where an image ratio is 5%. At the same time, the amount of the replaced carrier per sheet is 3.8 mg. The results of calculation on the basis of the foregoing are represented in FIG. 3 as a graph showing the transition of an average age.

Data indicated by a broken line in the drawing show results in the case where the CD ratio of the replenishment developer is 0%, that is, the amount of the mixed carrier is 0. In the line, the number of sheets is equal to the average age of carriers. FIG. 3 shows the results in the case where the image ratio is 10% and the results in the case where the image ratio is 50% as well.

As is apparent from FIG. 3, the use of the replenishment developer having a CD ratio of 15% causes the average age of carries to saturate at 90K sheets at the time point when the number of sheets on which images are outputted each having an image ratio of 5% is 300K (300,000). In contrast, the use of the replenishment developer having a CD ratio of 0% causes the average age of carries to saturate at 300K sheets at the same time point, with the result that the replacement of a developer is forced.

The level at which the carrier in the developer container deteriorates can be suppressed by discharging the carrier from the developer container, and, at the same time, replenishing the carrier upon replenishment with toner as described above.

Meanwhile, for additionally improving image quality, a technique for improving image quality has been proposed, which involves fixing, for example, transparent toner to an uppermost layer to improve the gloss of a surface.

For example, Japanese Patent Application Laid-Open No. H04-278967 proposes a technique for providing a color image having a color tone close to that of silver halide photography involving performing development by means of transparent toner on the entire surface of a region where an image can be formed to improve the gloss of an image surface.

In addition, Japanese Patent Application Laid-Open No. H05-006033, Japanese Patent Application Laid-Open No. H05-127437, and Japanese Patent Application Laid-Open No. 2000-147863 each propose a method of forming an image which has reduced irregularities due to toner built-up and is closer to silver halide photography involving: performing development by means of transparent toner on the entire surface of a region where an image can be formed to improve gloss; and adjusting the bearing amount of the transparent toner to form a surface having uniform surface property and equal texture.

However, the use of colored toner and transparent toner in a two-component development mode is found to cause such problem as described below.

In other words, when development by means of the transparent toner is performed on the entire surface of a region where an image can be formed, the image ratio of the transparent is much larger than that of the colored toner. Therefore, only in the case of the transparent toner, a toner consumption per image increases, and the number of times of replenishment with a developer also increases owing to the increase. As a result, the amount of a carrier with which a developing device is replenished also increases. Therefore, the frequency of the replacement of only a carrier for the transparent toner increases, and, when a cost for the carrier is high, a running cost increases in some cases.

That is, a high image ratio is disadvantageous in terms of running cost although a developer is stably present in a state with improved freshness because the frequency of the replacement of a carrier is high.

As can be seen from FIG. 3, the average age of carriers in the case where an image ratio is 5% is 10 times as long as that in the case where an image ratio is 50%. In other words, a cost for a carrier in the case where an image ratio is 50% is 10 times as high as that in the case where an image ratio is 5%.

In addition, the degree to which a carrier for colored toner deteriorates in association with an increase in number of sheets on which images are outputted does not coincide with the degree to which a carrier for transparent toner deteriorates in association with an increase in number of sheets on which images are outputted. Therefore, a balance between the bearing amount of the colored toner and that of the transparent toner is lost with increasing number of sheets on which images are outputted, so gloss and smoothness are lost in some cases. In other words, the thickness of only the toner of a colored portion increases with increasing number of sheets on which images are outputted, so gloss and smoothness are lost in some cases.

SUMMARY OF THE INVENTION

An object of the present invention is to considerably reduce a downtime for replacing a developer and to satisfy a low running cost when colored toner and transparent toner are used in a two-component development mode. Another object of the present invention is to form an image with good gloss and good smoothness.

In order to achieve the above-mentioned objects, there is provided a developing apparatus including:

a developing device for color receiving the colored toner and a carrier and developing the electrostatic image;

a developing device for transparence receiving the transparent toner and a carrier and developing the electrostatic image;

a developer replenishment container for color receiving a replenishment developer for color containing at least the colored toner and the carrier, the developing device for color being replenished with the replenishment developer for color;

a developer replenishment container for transparence receiving a replenishment developer for transparence containing at least the transparent toner and the carrier, the developing device for transparence being replenished with the replenishment developer for the transparence, wherein the replenishment developer for transparence has a carrier weight ratio lower than a carrier weight ratio in the replenishment developer for color;

a developer discharge aperture for color arranged in the developing device for color and discharging a developer in the developing device for color to an outside of the developing device for color in association with replenishment with the replenishment developer for color; and a developer discharge aperture for transparence arranged in the developing device for transparence and discharging a developer in the developing device for transparence to an outside of the developing device for transparence in association with replenishment with the replenishment developer for transparence.

Further, in order to achieve the above-mentioned objects, there is provided an image forming method including the steps of:

developing the electrostatic image by means of a developing device for color receiving the colored toner and a carrier;

developing the electrostatic image by means of a developing device for transparence receiving the transparent toner and a carrier;

replenishing the developing device for color with at least a replenishment developer for color containing the colored toner and a carrier from a developer replenishment container for color receiving the replenishment developer for color;

replenishing the developing device for transparence with a replenishment developer for transparence containing at least the transparent toner and a carrier from a developer replenishment container for transparence receiving the replenishment developer for transparence, wherein the replenishment developer for transparence has a carrier weight ratio lower than a carrier weight ratio in the replenishment developer for color;

discharging a developer in the developing device for color to an outside of the developing device for color from a developer discharge aperture for color arranged in the developing device for color in association with replenishment with the replenishment developer for color; and discharging a developer in the developing device for transparence to an outside of the developing device for transparence from a developer discharge aperture for transparence arranged in the developing device for transparence in association with replenishment with the replenishment developer for transparence.

DESCRIPTION OF THE PREFERRED EMBODIMENTS

Hereinafter, a developing apparatus and an image forming apparatus according to the present invention will be described in more detail with reference to the drawings.

First Embodiment

[Entire Constitution and Operation of Image Forming Apparatus]

Figure 1:
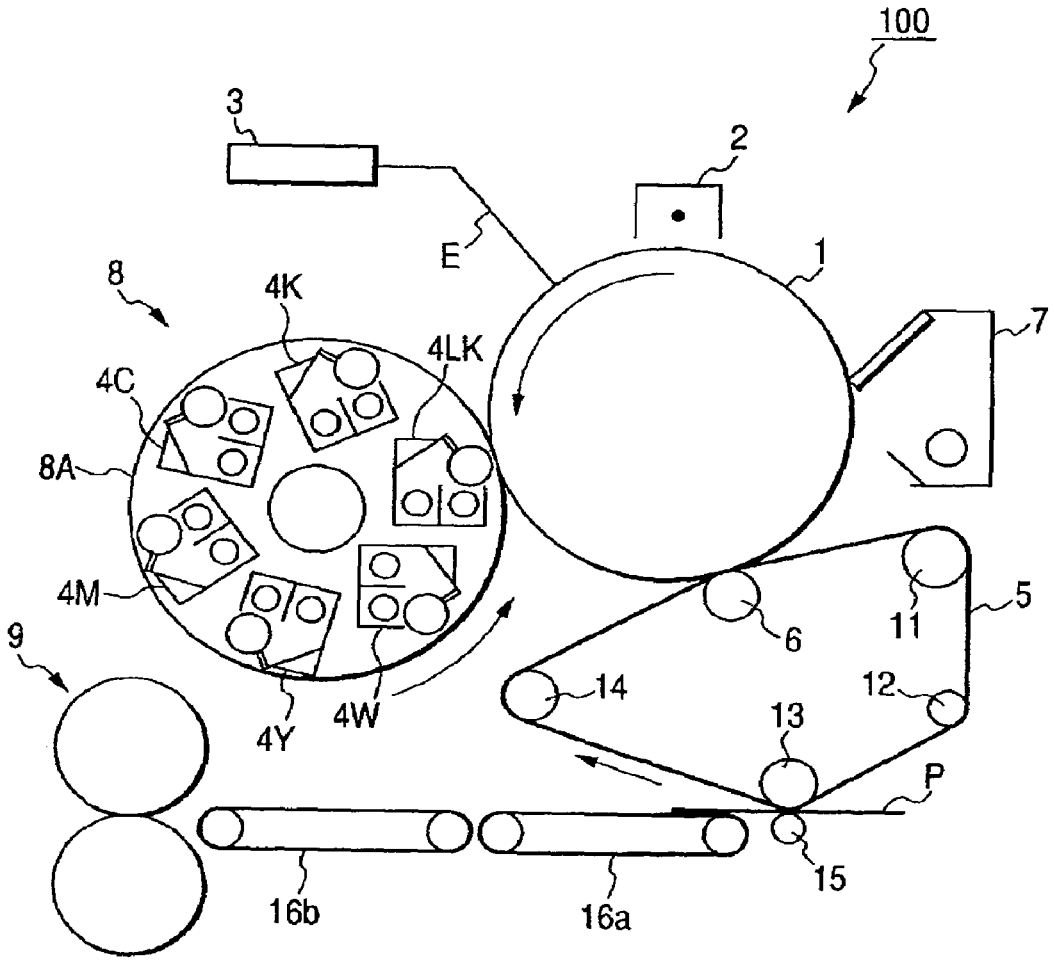
FIG. 1 is a schematic constitutional view of an embodiment of an image forming apparatus according to the present invention.

At first, the entire constitution and operation of an image forming apparatus will be described. FIG. 1 shows the schematic constitution of an image forming apparatus 100 of this embodiment. The image forming apparatus 100 is a full-color laser beam printer capable of forming a full-color image on a recording material such as recording paper, an OHP sheet, or a cloth according to an electrophotographic mode in accordance with an image information signal sent from an external device such as a personal computer communicably connected to the main body of the image forming apparatus.

The image forming apparatus 100 has a drum-shaped electrophotographic photosensitive member as an image bearing member, that is, a photosensitive drum 1. A charging device 2 as charging means, a laser exposing apparatus 3 as exposing means, a cleaner 7 as cleaning means, and a rotary developing apparatus 8 are arranged around the photosensitive drum 1. An intermediate transfer belt 5 as an intermediate transfer member suspended on rollers 11, 12, 13, and 14 is arranged opposite to the photosensitive drum 1.

The rotary developing apparatus 8 has a body of rotation (hereinafter, referred to as the "developing rotary") 8A arranged opposite to the photosensitive drum 1 and rotatably supported. The developing rotary 8A is mounted with developing devices for colored toner of five colors, that is, a developing device 4Y for yellow toner, a developing device 4M for magenta toner, a developing device 4C for cyan toner, a developing device 4K for black toner, and a developing device 4LK for light black toner, and, additionally, a developing device 4W for transparent toner as multiple developing means.

For example, upon formation of a full-color image, at first, the surface of the photosensitive drum 1 is charged by the charging device 2. Next, the charged surface of the photosensitive drum 1 is irradiated with an optical image E from the laser exposing apparatus 3, whereby an electrostatic image (latent image) is formed on the photosensitive drum 1. The latent image is developed by the rotary developing apparatus 8. In other words, the developing rotary 8A is rotated in the direction indicated by an arrow, and a predetermined developing device such as the developing device 4LK is moved to a developing portion opposite to the photosensitive drum 1. Then, the developing device 4LK is operated, whereby a developer image, that is, a toner image is formed on the photosensitive drum 1.

After that, the toner image formed on the photosensitive drum 1 is transferred onto the intermediate transfer belt 5 at a portion where the photosensitive drum 1 and the intermediate transfer belt 5 are opposite to each other (a primary transfer portion) by the action of a primary transfer bias applied to a primary transfer roller 6 as primary transferring means.

The repetition of the above operation results in the formation of a multiple toner image in which yellow toner, magenta toner, cyan toner, black toner, light black toner, and transparent toner are sequentially superimposed on one another on the intermediate transfer belt 5. In this embodiment, in order that the gloss and smoothness of an image may be improved, a portion having a large bearing amount of colored toner has a small amount of transparent toner corresponding to the bearing amount superimposed thereon and a portion having a small bearing amount of colored toner has a large amount of transparent toner corresponding to the bearing amount superimposed thereon in the entire surface of a region where an image can be formed so that the multiple toner image becomes a substantially uniform plane. Alternatively, a toner image may be formed by: causing the entire surface of a region where an image can be formed to bear transparent toner; and causing the resultant to bear colored toner and transparent toner in such manner that a substantially uniform plane is obtained. An image forming method involving the use of transparent toner is arbitrary in the present invention, and any available method can be appropriately selected and used.

The multiple toner image formed on the intermediate transfer belt 5 is transferred onto a recording material P at a portion where a secondary transfer roller 15 as secondary transferring means and the intermediate transfer belt 5 are opposite to each other (a secondary transfer portion) by the action of a secondary transfer bias applied to the secondary transfer roller 15. The recording material P is conveyed from a recording material supplying portion (not shown) to the secondary transfer portion in accordance with the timing at which the tip of the multiple toner image on the intermediate transfer belt 5 is conveyed to the secondary transfer portion.

The recording material P onto which the toner image has been transferred is conveyed by conveying belts 16*a* and 16*b* to a roller fixing device 9 as fixing means. The recording material P is pressurized/heated by the fixing device 9, so the toner image is fixed thereto as a permanent image. After that, the recording material P is discharged to the outside of the apparatus.

In addition, primary transfer residual toner remaining on the photosensitive drum 1 after the primary transfer step is removed by the cleaner 7. Furthermore, secondary transfer residual toner remaining on the intermediate transfer belt 5 after the secondary transfer step is removed by a transfer belt cleaner (not shown).

[Developing Device]

Next, the developing devices 4 (4Y, 4M, 4C, 4K, 4LK, and 4W) will be described in detail with reference to FIG. 2. In this embodiment, the respective developing devices 4Y, 4M, 4C, 4K, 4LK, and 4W have substantially the same constitution except for the color of toner to be used.

The developing devices 4 each have a developer container 41, and the developer container 41 receives a two-component developer (developer) T including non-magnetic toner (toner) and a magnetic carrier (a carrier). The developer container 41 has an opening 41*a* in a region opposite to the photosensitive drum 1, and a developing sleeve 42 as a developer carrier is rotatably arranged so that part of the sleeve is exposed to the opening 41*a*. The developing sleeve 42 is constituted by a non-magnetic material, and a fixed magnet 43 as magnetic field generating means is arranged in the sleeve. In addition, agitating screws 45 and 46 are arranged in the developer container 41. The developer T in the developer container 41 is circulated and conveyed while being agitated by the agitating screws 45 and 46.

Figure 2:
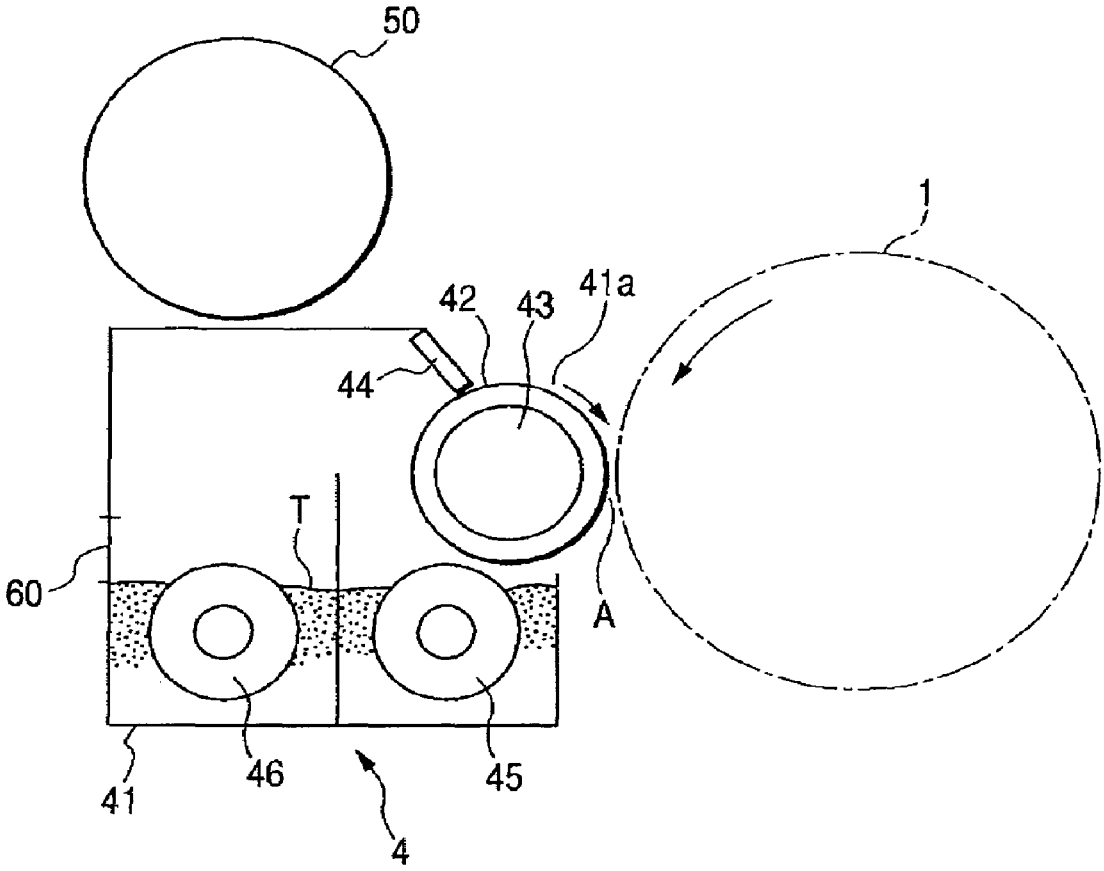
FIG. 2 is a schematic constitutional view of a developing device of the image forming apparatus of FIG. 1.
Figure 3:
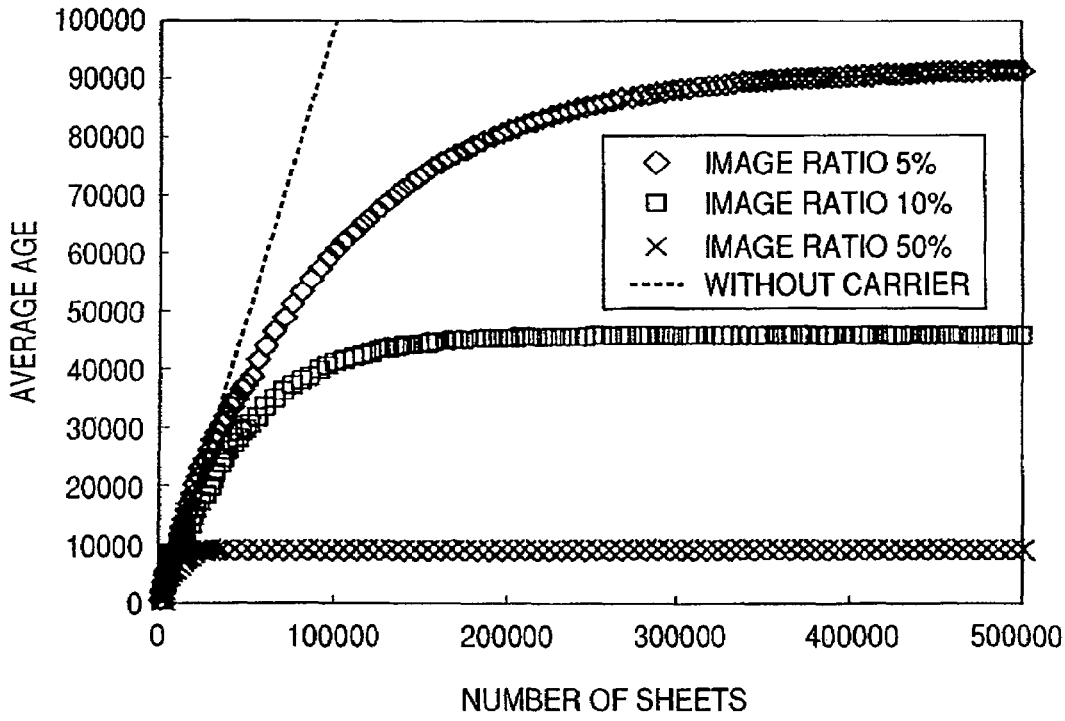
FIG. 3 is a graph for explaining the average age of carriers.

At the time of a development operation, the developing sleeve 42 rotates in the direction indicated by an arrow shown in FIG. 2, and carries the developer T in the developer container 41. In association with the rotation of the developing sleeve 42, a blade 44 as a developer regulating member regulates the amount of the developer T to turn the developer into a layer shape. The layer-shaped developer T is conveyed to a developing region A opposite to the photosensitive drum 1. Then, in the developing region A, toner is supplied from the developer T to the photosensitive drum 1 in accordance with an electrostatic image. As a result, the electrostatic image formed on the photosensitive drum 1 is developed as a toner image. The developer T after the development of the electrostatic image is conveyed in accordance with the rotation of the developing sleeve 42, and is then collected in the developer container 41.

A developing bias obtained by superimposing an alternating voltage to a direct voltage is applied from developing bias generating means (not shown) to the developing sleeve 42. In this embodiment, the waveform of an alternating current component of the developing bias is a rectangular wave with, for example, a frequency of 2 kHz and Vpp of 2 kV. The developing bias forms an alternating electric field between the developing sleeve 42 and the photosensitive drum 1, and the toner is electrically peeled off the carrier to form a toner mist, whereby development efficiency increases.

A developer will be described in detail. Colored toner to be used is one having a volume average particle diameter of about 8 μm obtained by: mixing a resin binder mainly composed of polyester with a pigment; pulverizing the mixture; and classifying the pulverized product. In this embodiment, light black toner as pale color toner was produced by reducing the number of parts of a pigment to be incorporated into black toner as deep color toner.

In addition, transparent toner is one composed of a resin free of any coloring agent having high light transmittance and an average particle diameter of 1 to 25 μm, for example, a styrene-acrylic copolymer resin obtained by the copolymerization of a styrene-based monomer such as styrene and an acrylate monomer such as butyl acrylate and/or a methacrylate monomer such as methyl methacrylate. A thermoplastic resin such as a polyester resin, or any other thermosetting resin can also be used for the toner. The transparent toner is substantially colorless, and transmits at least visible light well with substantially no scattering.

Furthermore, an arbitrary component can be added as required. For example, the addition of any one of waxes, aliphatic acids, and metal soaps of aliphatic acids easily forms a uniform coating upon thermal melting of transparent toner at the time of fixation, whereby a color image with improved transparency and excellent surface gloss can be obtained. In addition, a preventing effect on offset can be exerted upon fixation by means of a heated roll. Alternatively, silica, alumina, titania (titanium oxide), an organic resin particle, or the like can be added as an external additive for the purpose of securing the flowability and charging property of toner.

A carrier to be used is one obtained by coating a core mainly composed of ferrite with a silicone resin and having a 50% particle diameter ($D_{50}$) of 40 μm.

Such toner and carrier are mixed at a weight ratio of about 8:92, and are used as a two-component developer having a toner concentration (TD ratio) of 8%.

[Developer Replenishment Mechanism]

Next, a characteristic portion of the present invention will be described.

In this embodiment, the developing apparatus 8 has a developer replenishment mechanism for replenishing the developer container 41 of each developing device 4 with a replenishment developer containing at least toner and a carrier as a replenishment developer. In addition, the developing apparatus 8 has a developer discharge mechanism for discharging a developer from the developer container 41 of each developing device 4.

In other words, when toner is consumed by image formation, the consumed amount of toner is replenished from a developer replenishment tank (developer replenishment container) 50. In this embodiment, a replenishment developer replenished from the developer replenishment tank 50 is a mixture of toner and a carrier. The developer container 41 is replenished with a new carrier simultaneously with the compensation for toner consumed by image formation. In other words, in this embodiment, the developer replenishment mechanism is constituted by providing each developing device 4 with the developer replenishment tank 50 and a replenishment member (not shown) for conveying a replenishment developer from the developer replenishment tank 50 to a replenishment aperture (not shown) arranged in the developer container 41 and for supplying the replenishment developer to the developer container 41 from the replenishment aperture. In this embodiment, the replenishment member is a rotatable screw, and is driven in accordance with the amount of a replenishment developer to be replenished determined in association with image formation to supply a predetermined amount of the replenishment developer to the developer container 41. Thus, the developer replenishment mechanism replenishes each developing device 4 with at least toner and a carrier at a predetermined weight ratio.

The amount of a replenishment developer to be replenished may be determined by means of any method. For example, any one, or a combination of all or two or more, of an inductance detection automatic toner replenishing apparatus (ATR), an optical detection ATR, a patch detection ATR, and a video count ATR which are known to one skilled in the art can be suitably used. The inductance detection ATR directly detects the toner concentration of a developer in the developer container 41 by means of an inductance sensor for detecting the permeability of the developer, and can determine the amount of a replenishment developer to be supplied in accordance with the toner concentration. The optical detection ATR directly detects the toner concentration of the developer in the developer container 41 by means of, for example, a reflection optical sensor, and can determine the amount of a replenishment developer to be supplied in accordance with the toner concentration. The patch detection ATR forms a predetermined standard toner image (patch image) on a photosensitive member (or an intermediate transfer member or a recording material bearing member), detects the image density of the image by means of, for example, a reflection optical sensor, indirectly detects the toner concentration of the developer in the developer container 41, and can determine the amount of a replenishment developer to be supplied in accordance with the toner concentration. The video count ATR calculates a toner usage amount on the basis of the integrated value of density information for each pixel of an image to be formed, estimates the toner concentration of the developer in the developer container 41, and can determine the amount of a replenishment developer to be supplied in accordance with the estimation. In the present invention, a method of controlling replenishment with a replenishment developer is arbitrary in itself, and any available method can be appropriately selected and used.

Meanwhile, the amount of the developer present in the developer container 41 increases by the amount of a new carrier with which the developer container 41 is replenished. The increased amount is discharged from a developer discharge aperture 60 arranged on the wall surface of the developer container 41. The position of the developer discharge aperture 60 is adjusted in such a manner that the amount of the developer in the developer container 41 is stably 375 g. The discharged developer is collected with a collection screw (not shown) arranged at the center of the developing rotary 8A, and is collected in a waste developer container (not shown). In other words, in this embodiment, the developer discharge mechanism is constituted by the developer discharge aperture 60 and waste developer carrying means (not shown) for carrying the developer discharged from the developer discharge aperture 60 to the waste developer container.

Hereinafter, each developer replenishment tank 50 for receiving toner of each color (yellow, magenta, cyan, black, or light black) is referred to as the "replenishment tank for colored toner", while the developer replenishment tank 50 for receiving transparent toner is referred to as the "replenishment tank for transparent toner". Each of those developer replenishment tanks may be constituted so as to be detachably mountable to the main body of an image forming apparatus.

In addition, in this embodiment, the weight ratio of the carrier of the replenishment developer with which the replenishment tank 50 for colored toner was to be filled, that is, the CD ratio (the ratio of the carrier weight to the total weight of a developer) and the CD ratio in the case of the replenishment tank 50 for transparent toner were changed, and the CD ratio of the replenishment developer in the replenishment tank for transparent toner was made lower than that in the replenishment tank for colored toner.

To be specific, the CD ratio of the replenishment developer in the replenishment tank for transparent toner was 6.4%, while the CD ratio of the replenishment developer in each replenishment tank for colored toner was 15%. Therefore, the initial total weight of the replenishment developer in each developer replenishment tank 50 was 400 g. The replenishment tank for transparent toner was filled with 374.4 g of toner and 25.6 g of a carrier, while each replenishment tank for colored toner was filled with 340 g of toner and 60 g of a carrier. That is, in this embodiment, the weight of the transparent toner with which the replenishment tank for transparent toner is filled is different from the weight of the colored toner with which each replenishment tank for colored toner is filled. The weight of the transparent toner with which the replenishment tank for transparent toner is filled is larger than the weight of the colored toner with which each replenishment tank for colored toner is filled.

Figure 4:
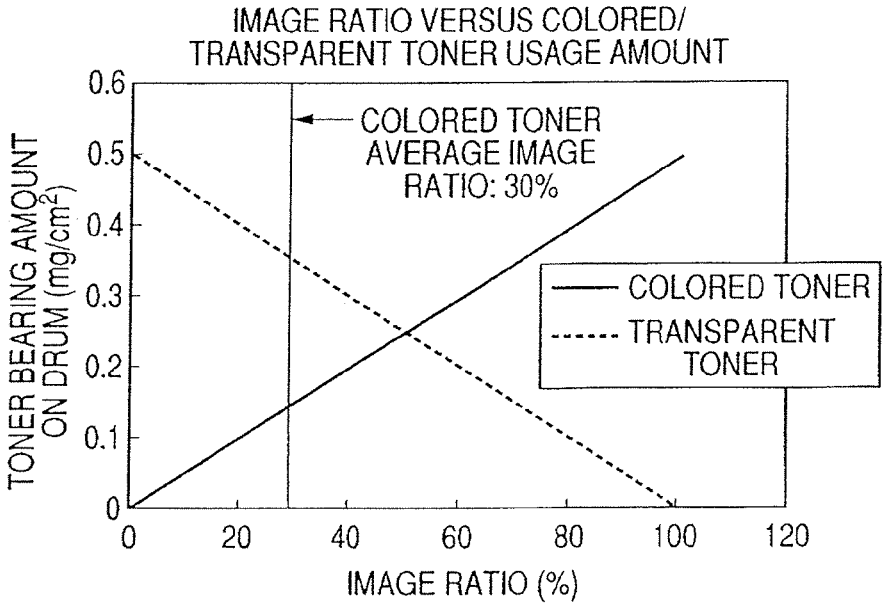
FIG. 4 is a graph for explaining the usage amounts of colored toner and transparent toner in a transparent toner system.

In this embodiment, a ratio between the CD ratios of the replenishment developers in the replenishment tank for transparent toner and in each replenishment tank for colored toner was determined as follows. In other words, as shown in FIG. 4, when an image is formed by means of transparent toner for improving the gloss and smoothness of the image, the average image ratio of images produced by the transparent toner used in an assumed ordinary manner is about 70%, and the average image ratio of images produced by each colored toner is about 30%. In view of the foregoing, calculation was performed on the basis of the fact that the average age of carriers for the transparent toner was substantially equal to or smaller than three sevenths that of carriers for each colored toner. A ratio between the CD ratios of the replenishment developers in the replenishment tank for transparent toner and in each replenishment tank for colored toner was determined in such a manner that a CD rate of the CD ratio of the replenishment developer with which each replenishment tank for colored toner was to be filled to the CD ratio of the replenishment developer with which the replenishment tank for transparent toner was to be filled would be ⅔or smaller.

Of course, the average image ratio changes depending on the user and environment of the image forming apparatus 100. Therefore, the CD ratios of the replenishment developers can be adjusted in accordance with the changes so that the CD ratio of the replenishment developer in the replenishment tank for transparent toner is lower than that in each replenishment tank for colored toner.

Hereinafter, the results of investigation will be described.

Figure 5:
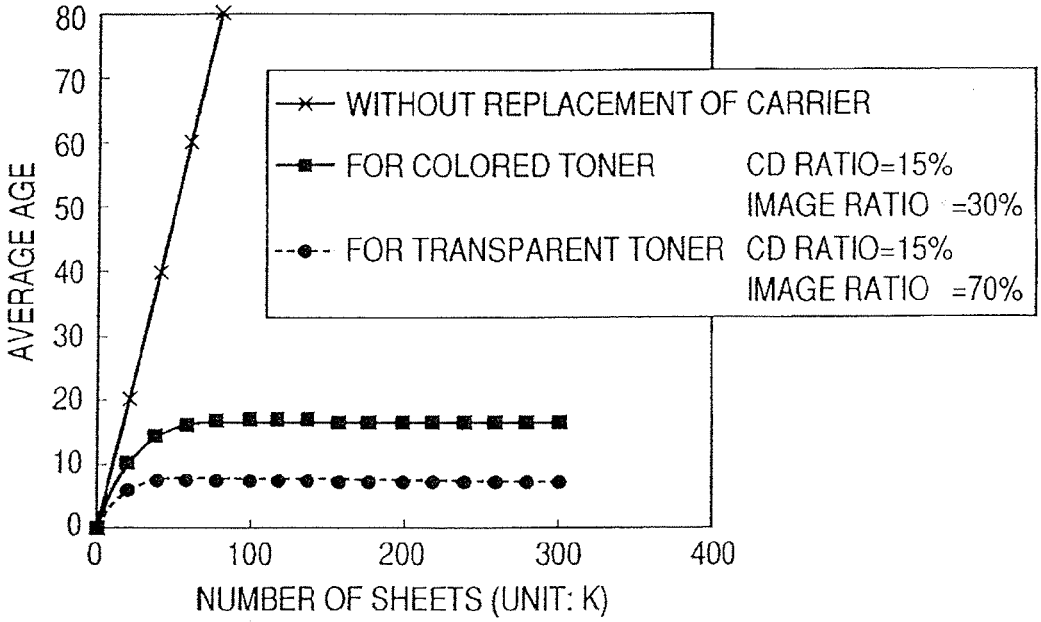
FIG. 5 is a graph showing the average age of carriers in a conventional example.

FIG. 5 shows a relationship between the average age of carriers in a developing device and the number of sheets (A4-size recording materials) on each of which an image is outputted in a conventional example. In the conventional example, at first, all the CD ratios of the replenishment developers in the replenishment tank for transparent toner and in the replenishment tanks for colored toner are uniformly 15%, and the image ratio of an image produced by each colored toner is 30%, while the image ratio of an image produced by the transparent toner is 70%. A solid line in FIG. 5 shows a relationship for each colored toner and a broken line in FIG. 5 shows a relationship for the transparent toner.

The average age of carriers for the transparent toner is lower than that of carriers for each colored toner because of the following reason. The image ratio of an image produced by the transparent toner is higher than that of an image produced by the colored toner, so the replacement rate of the carriers for the transparent toner increases.

Figure 6:
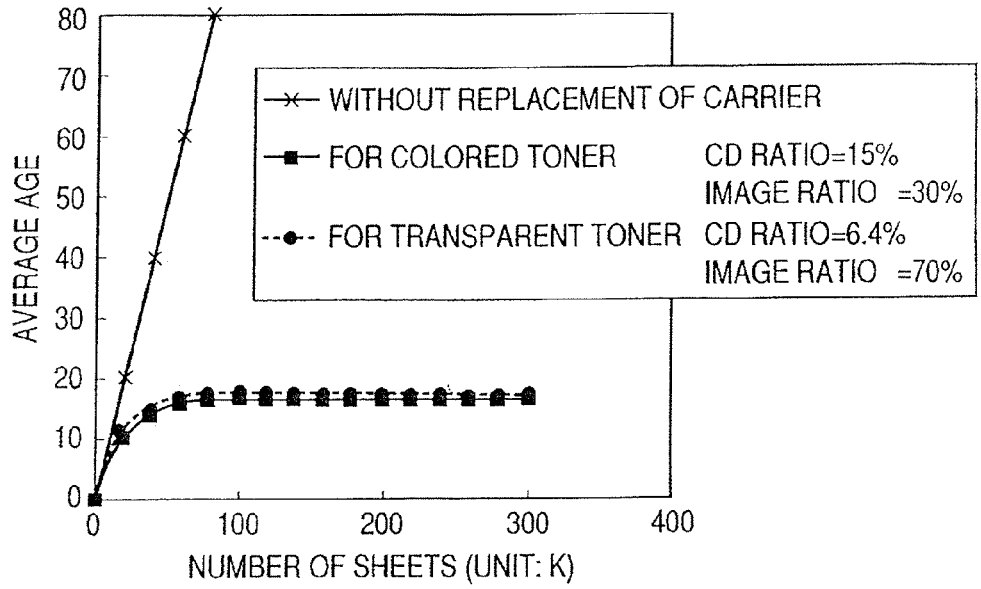
FIG. 6 is a graph showing the average age of carriers in first Embodiment.

Therefore, a solid line and a broken line in FIG. 6 show a relationship between the average age of carriers in a developing device and the number of sheets on which images are outputted for each colored toner and that for the transparent toner when a CD ratio commensurate with an average image ratio is set in view of the above phenomenon, specifically, the CD ratio of the replenishment developer in each replenishment tank for colored toner is 15% and the CD ratio of the replenishment developer in the replenishment tank for transparent toner is 6.4%. The average age of carriers for each colored toner and the average age of carriers for the transparent toner can be made identical to each other with no difference by making the CD ratio of the replenishment developer in the replenishment tank for transparent toner lower than the CD ratio of the replenishment developer in each replenishment tank for colored toner as described above.

Table 1 shows the transition of the triboelectricity of toner in a developing device, the transition of the smoothness of an image, and a cost for a carrier for transparent toner when a cost for a carrier for colored toner is set to 1 in association with an increase in number of sheets (A4-size recording materials) on each of which an image is outputted in each of the conventional example and this embodiment (the unit price for carriers themselves for the colored toner is the same as the unit price for carriers themselves for the transparent toner).

An image was evaluated for smoothness as follows. An image created on the basis of a photograph original including a person was visually evaluated for image quality. The image was evaluated for image quality by 20 evaluators on the basis of the following four stages.

1: A structure line is observed in the entire image. The image is not preferable because it is completely different from a silver halide photographic paper photograph.

2: A structure line is partially observed and annoying. The image is not preferable because it is different from a silver halide photographic paper photograph.

3: A structure line is partially observed, but is not annoying. The image is slightly preferable because it is close to a silver halide photographic paper photograph.

4: No structure line is observed. The image is preferable because it is close to a silver halide photographic paper photograph.

Next, the average value of the smoothness was determined and evaluated on the basis of the following criteria.

B: The average value is less than 2.5.

A: The average value is 2.5 or more and less than 3.5.

AA: The average value is 3.5 or more.

The transition of the average age of carriers in association with an increase in number of sheets on which images are outputted in the conventional example is as shown in FIG. 5. Furthermore, the transition of the average age of carriers in association with an increase in number of sheets on which images are outputted in this embodiment is as shown in FIG. 6.

TABLE 1

| | | Number of durable sheets | | | |
|---|---|---|---|---|---|
| | | 0k | 50k | 200k | 300k |
| Conventional example | Colored CD 15% triboelectricity (μQ/mg) | 30 | 27 | 26 | 26 |
| | Transparent CD 15% triboelectricity (μQ/mg) | 30 | 29 | 29 | 29 |
| | Smoothness (average of visual observation by 20 persons) | AA | A | B | B |
| | Transparent/colored cost ratio | — | 2.33 | 2.33 | 2.33 |
| First Embodiment | Colored CD 15% triboelectricity (μQ/mg) | 30 | 27 | 26 | 26 |
| | Transparent CD 6.4% triboelectricity (μQ/mg) | 30 | 27 | 26 | 26 |
| | Smoothness (average of visual observation by 20 persons) | AA | AA | AA | AA |
| | Transparent/colored cost ratio | — | 1.00 | 1.00 | 1.00 |

As shown in FIG. 5, the average age of carriers for transparent toner is lower than the average age of carriers for colored toner in the case where all the CD ratios of the replenishment developers in the replenishment tanks for colored toner and in the replenishment tank for transparent toner are uniformly 15% when the average image ratio of images produced by the colored toner is 30%, while the average image ratio of images produced by the transparent toner is 70%. Therefore, as shown in Table 1, in the conventional example, a difference in triboelectricity between colored toner and transparent toner occurs with increasing number of sheets on which images are outputted. As a result, even when the toner thickness of an image portion (colored portion) bearing colored toner and that of a non-image portion (colorless portion) bearing transparent toner are matched with each other at an initial stage, the bearing amount of toner changes with increasing number of sheets on which images are outputted. As a result, smoothness on an image is lost.

Figure 8:
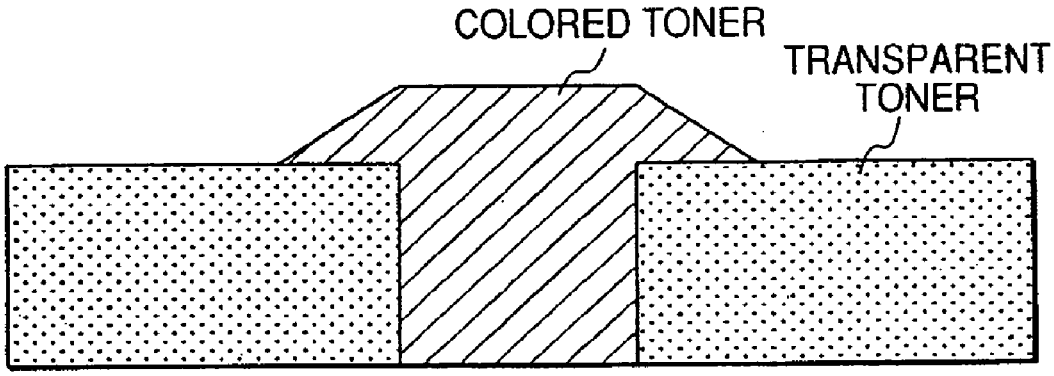
FIG. 8 is a schematic view showing a relationship between the transparent toner and colored toner of an image after fixation in a conventional example.

To be specific, the triboelectricity of colored toner is lower than that of transparent toner. Therefore, even when the same latent image as that at an initial stage is formed, in order that the colored toner with reduced triboelectricity in association with an increase in number of sheets on which images are outputted may compensate for the same latent image potential as that at the initial stage, the bearing amount of the toner is larger than that at the initial stage. On the other hand, the triboelectricity of the transparent toner is substantially the same as that at the initial stage. Therefore, the recording material P after fixation may bear toner in a state where only a colored toner image swells as shown in FIG. 8. Then, the irregularities of the colored toner are characterized in that they are apt to be observed by the eyes of a human being, with the result that the smoothness of an image seems to be lost.

In contrast, in this embodiment, in consideration of the fact that the average image ratio of images produced by each colored toner is 30%, while the average image ratio of images produced by the transparent toner is 70%, the CD ratio of the replenishment developer in each replenishment tank for colored toner is adjusted to 15% and the CD ratio of the replenishment developer in the replenishment tank for transparent toner is adjusted to 6.4% in advance. As a result, the average age of carriers for each colored toner and the average age of carriers for the transparent toner are substantially equal to each other. Therefore, as shown in Table 1, in this embodiment, no difference in triboelectricity between the colored toner and the transparent toner occurs with increasing number of sheets on which images are outputted. As a result, when the toner thickness of an image portion (colored portion) bearing the colored toner and that of a non-image portion (colorless portion) bearing the transparent toner are matched with each other at an initial stage, a balance between the triboelectricity of the colored toner and that of the transparent toner is not lost although the triboelectricity of toner changes with increasing number of sheets on which images are outputted. A balance between the thickness of the colored toner and that of the transparent toner on an image is not lost either. As a result, smoothness on the image is not lost.

Changing the CD ratio of the replenishment developer in the replenishment tank for transparent toner provides another advantage: the amount of toner in the replenishment tank for transparent toner is large out of the amount of toner in the developer replenishment tanks 50. In other words, the usage amount of transparent toner is typically larger than that of colored toner, and, in this embodiment, increasing the amount of toner in the developer replenishment tanks 50 can lengthen the replacement interval of the replenishment tank for transparent toner.

Furthermore, as can be seen from the results shown in Table 1, in this embodiment, the usage amount of a transparent carrier can be reduced, so a ratio of a cost for a carrier for transparent toner to a cost for a carrier for colored toner can be made lower than the conventional one.

The CD ratio of a replenishment developer in a replenishment tank for transparent toner or colored toner is appropriately in the range of 5 to 50%. When the CD ratio is lower than 5%, a replacement effect provided by replenishment with a carrier is small. When the CD ratio exceeds 50%, the amount of toner to contribute to development is so small that a concentration follow-up ability upon development deteriorates.

Therefore, according to this embodiment, the degree to which a carrier deteriorates in each developing device for colored toner and the degree to which a carrier deteriorates in the developing device for transparent toner can be substantially equal to each other, and the gloss and smoothness of an image can be maintained. At the same time, a running cost can be reduced. In other words, according to this embodiment, when a system in which colored toner and transparent toner are used in a two-component development mode is adopted, the smoothness and gloss of an image can be favorably maintained, and a running cost can be satisfied while a downtime due to the replacement of a developer is eliminated.

Second Embodiment

Next, another embodiment of the present invention will be described. The basic constitution and operation of an image forming apparatus of this embodiment are the same as those of first Embodiment. Therefore, the same reference numerals are given to components having functions substantially identical or corresponding to those of the image forming apparatus of first Embodiment, and detailed description of the components is omitted.

Figure 7:
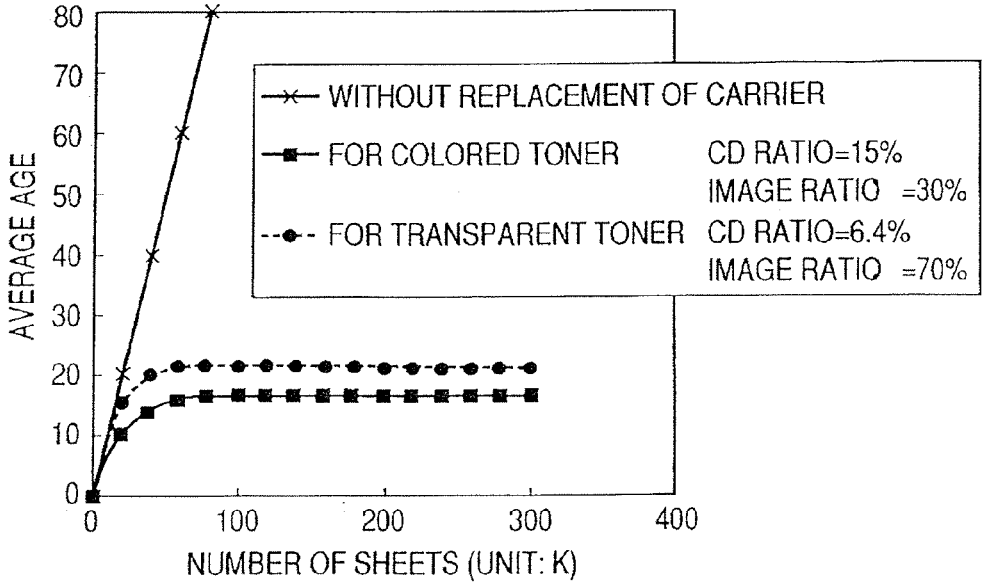
FIG. 7 is a graph showing the average age of carriers in second Embodiment.

In this embodiment, investigation was conducted while the CD ratio of the replenishment developer in the replenishment tank for transparent toner was further reduced from 6.4% to 5%. The CD ratio of the replenishment developer in each replenishment tank for colored toner was the same as that of first Embodiment, that is, 15%. FIG. 7 and Table 2 show the results of the investigation. An image is evaluated in conformance with the method of first Embodiment.

TABLE 2

| | | Number of durable sheets | | | |
|---|---|---|---|---|---|
| | | 0k | 50k | 200k | 300k |
| Conventional example | Colored CD 15% triboelectricity (μQ/mg) | 30 | 27 | 26 | 26 |
| | Transparent CD 15% triboelectricity (μQ/mg) | 30 | 29 | 29 | 29 |
| | Smoothness (average of visual observation by 20 persons) | AA | A | B | B |
| | Transparent/colored cost ratio | — | 2.33 | 2.33 | 2.33 |
| Second Embodiment | Colored CD 15% triboelectricity (μQ/mg) | 30 | 27 | 26 | 26 |
| | Transparent CD 5% triboelectricity (μQ/mg) | 30 | 26 | 25 | 25 |
| | Smoothness (average of visual observation by 20 persons) | AA | AA | A | A |
| | Transparent/colored cost ratio | — | 0.78 | 0.78 | 0.78 |

Figure 9:
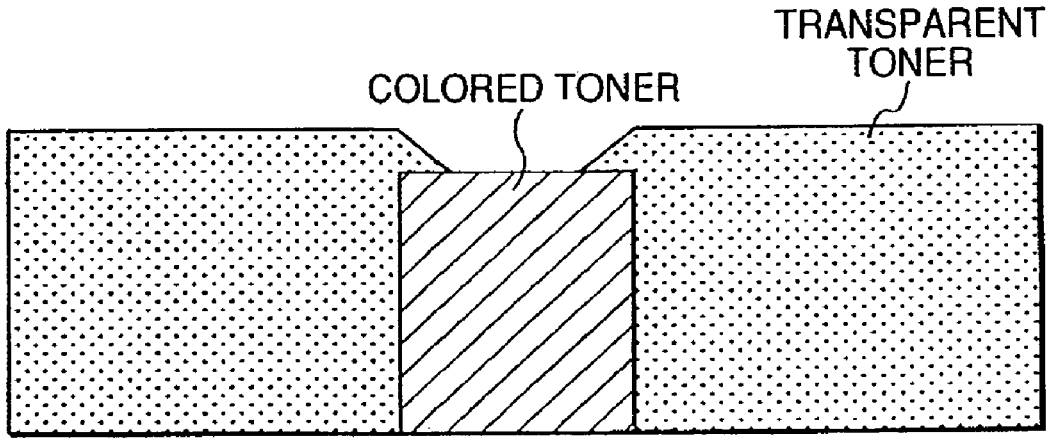
FIG. 9 is a schematic view showing a relationship between the transparent toner and colored toner of an image after fixation in second Embodiment.

As shown in FIG. 7, in this embodiment, the average age of carriers for transparent toner is slightly higher than the average age of carriers for colored toner. Therefore, the triboelectricity of the transparent toner reduces as compared to that of the colored toner with increasing number of sheets on which images are outputted. Accordingly, when the number of sheets on which images are outputted increases, the toner thickness of the transparent toner on the recording material P is larger than the toner thickness of the colored toner, so the transparent toner may slightly swell as compared to the colored toner. FIG. 9 shows how the recording material P after fixation in this state bears toner. Fixation may occur in such a manner that part of the transparent toner adjacent to the portion bearing the colored toner rolls in the portion of the colored toner. However, the transparent toner itself is transparent, so slight irregularities of the bearing toner do not immediately lead to a reduction in smoothness. The transparent toner is characterized in that, even when the bearing amount of the transparent toner slightly varies, a fluctuation in tint of an image and a conspicuous image failure hardly occurs. Therefore, there is no need to cause a developer in a developing device to be stably present in a particularly fresh state as compared to colored toner. When a cost for a carrier is high, rather, reducing a replacement frequency can avoid an increase in running cost.

As can be seen from the results shown in Table 2, in this embodiment, the smoothness of an image is maintained, and the usage amount of a transparent carrier can be made lower than that of first Embodiment.

Therefore, according to this embodiment, a ratio of a cost for a carrier for transparent toner to a cost for a carrier for colored toner can be additionally reduced without the impairment of the smoothness and gloss of an image.

In first and second Embodiments described above, the following procedure may be adopted. A video count (such as the integrated value of laser light emission) is measured so that an image ratio is calculated. The usage ratio of the transparent toner is determined from the calculated value by means of the properties of FIG. 4, and a toner container having a CD ratio in accordance with the usage ratio is selected. In this case, for example, the main body of an image forming apparatus may be provided with developer replenishment tanks (toner containers) having multiple kinds of CD ratios in advance, and an optimum one may be automatically selected from the ratios upon replacement of a tank. Alternatively, the main body of the apparatus may display an optimum CD ratio, and a user may mount a container having a CD ratio in accordance with the displayed value.

In addition, in each of the above embodiments, the absolute amount of a developer may be adjusted to be low for the purpose of reducing the average age of carriers in a developer container. This action aims to reduce an average age by reducing the amount of a developer so that the developer can be replaced quickly. For example, in an image forming apparatus used in a situation where an average image ratio is about 30% as shown in FIG. 4, a difference in usage ratio between developing devices different from each other in amount of a developer of about 2.3 times occurs (the amount of transparent toner to be used is about 2.3 times as large as that of colored toner to be used). Accordingly, in a use situation where an average image ratio is about 30%, the average age of carriers in a developing device for transparent toner and the average age of carriers in a developing device for colored toner can be made theoretically substantially equal to each other by setting the amount of a developer in the developer container of the developing device for transparent toner to 115 g and the amount of a developer in the developer container of the developing device for colored toner to 50 g on condition that a carrier ratio in the developing device for colored toner and a carrier ratio in the developing device for transparent toner are equal to each other.

In view of such circumstances, the constitution of the present invention in which the carrier ratio of a replenishment developer having transparent toner having a high usage ratio is made lower than that of a replenishment developer having colored toner with a view to matching the average age of carriers in a developing device for transparent toner and the average age of carriers in a developing device for colored toner with each other is effective when a ratio of the amount of a developer in a developer container for transparent toner to the amount of a developer in a developer container for colored toner is equal to or smaller than a usage ratio of the transparent toner to the colored toner at an assumed average image ratio. For example, when an average image ratio is 30%, a usage ratio of transparent toner to colored toner is about 2.3, so the present invention is effective as long as a ratio of the amount of a developer in a developer container for transparent toner to the amount of a developer in a developer container for colored toner is equal to or smaller than 2.3.

The present invention has been described above on the basis of specific embodiments. However, the present invention is not limited to the above embodiments.

For example, in each of the above embodiments, a mode in which an image forming apparatus has one photosensitive member provided with multiple developing devices is adopted, and description has been particularly given of the case where a rotary developing device is used. However, the present invention is not limited thereto. For example, a tandem-type image forming apparatus has been known to one skilled in the art. In the tandem-type image forming apparatus, multiple image forming portions (image forming stations) each having a photosensitive member are horizontally or longitudinally arranged in tandem with each other, and toner images formed on the photosensitive members of the respective image forming portions are superimposed and transferred onto a recording material or an intermediate transfer member on a recording material bearing member. The present invention is similarly applicable to such tandem-type image forming apparatus. Alternatively, the following procedure may be adopted. In a mode in which one photosensitive member is provided with multiple developing devices, at least one of the developing devices is arranged opposite to the photosensitive member, and a predetermined developing device is brought close to or into contact with the photosensitive member at a predetermined timing, whereby an electrostatic image on the photosensitive member is developed by means of the predetermined developing device.

In addition, a four-color mode in which an image is formed by means of four colors (Y, M, C, and K) as a productivity priority mode and a mode in which an image is formed by means of six colors (W, Y, M, C, K, and LK) or three colors (W, K, and LK) as a high-image-quality mode or a special mode may be provided. In this case, compatibility between a toner consumption and productivity can be achieved in accordance with the needs of various users. Furthermore, a mode in which an image is formed by means of five colors (W, Y, M, C, and K) may be provided. Alternatively, of course, an image forming apparatus including any one or all of developing devices using an increased number of kinds of pale color toner such as pale yellow toner, pale magenta toner, and pale cyan toner can also be used.

This application claims priority from Japanese Patent Application No. 2005-063180 filed on Mar. 7, 2005, which is hereby incorporated by reference herein.

What is claimed is:

1. A developing apparatus for developing an electrostatic image by means of colored toner and transparent toner, comprising:

a developing device for color receiving the colored toner and a carrier and developing the electrostatic image;

a developing device for transparence receiving the transparent toner and a carrier and developing the electrostatic image;

a developer replenishment container for color receiving a replenishment developer for color containing at least the colored toner and the carrier, the developing device for color being replenished with the replenishment developer for color;

a developer replenishment container for transparence receiving a replenishment developer for transparence containing at least the transparent toner and the carrier, the developing device for transparence being replenished with the replenishment developer for the transparence, wherein the replenishment developer for transparence having a carrier weight ratio lower than a carrier weight ratio in the replenishment developer for color;

a developer discharge aperture for color arranged in the developing device for color and discharging a developer in the developing device for color to an outside of the developing device for color in association with replenishment with the replenishment developer for color; and a developer discharge aperture for transparence arranged in the developing device for transparence and discharging a developer in the developing device for transparence to an outside of the developing device for transparence in association with replenishment with the replenishment developer for transparence.

2. A developing apparatus according to claim 1, wherein a weight of the transparent toner received by the developer replenishment container for transparence is larger than a weight of the colored toner received by the developer replenishment container for color in a state before a replenishment operation.

3. A developing apparatus according to claim 1 or 2, wherein the carrier weight ratio in the replenishment developer for transparence and the carrier weight ratio in the replenishment developer for color are each in a range of 5% to 50%, inclusively.

4. An image forming method of developing an electrostatic image by means of colored toner and transparent toner, comprising the steps of:

developing the electrostatic image by means of a developing device for color receiving the colored toner and a carrier;

developing the electrostatic image by means of a developing device for transparence receiving the transparent toner and a carrier;

replenishing the developing device for color with at least a replenishment developer for color containing the colored toner and a carrier from a developer replenishment container for color receiving the replenishment developer for color;

replenishing the developing device for transparence with a replenishment developer for transparence containing at least the transparent toner and a carrier from a developer replenishment container for transparence receiving the replenishment developer for transparence, wherein the replenishment developer for transparence has a carrier weight ratio lower than a carrier weight ratio in the replenishment developer for color;

discharging a developer in the developing device for color to an outside of the developing device for color from a developer discharge aperture for color arranged in the developing device for color in association with replenishment with the replenishment developer for color; and discharging a developer in the developing device for transparence to an outside of the developing device for transparence from a developer discharge aperture for transparence arranged in the developing device for transparence in association with replenishment with the replenishment developer for transparence.

5. An image forming method according to claim 4, wherein a weight of the transparent toner received by the developer replenishment container for transparence is larger than a weight of the colored toner received by the developer replenishment container for color in a state before a replenishment operation.

6. An image forming method according to claim 4 or 5, wherein the carrier weight ratio in the replenishment developer for transparence and the carrier weight ratio in the replenishment developer for color are each in a range of 5% to 50%, inclusively.

* * * * *